United States Patent [19]

Sansen

[11] 4,149,290

[45] Apr. 17, 1979

[54] BOOT STRAIGHTENING DEVICE

[76] Inventor: Millard D. Sansen, 2216 Woodburn, Colorado Springs, Colo. 80906

[21] Appl. No.: 891,333

[22] Filed: Mar. 29, 1978

[51] Int. Cl.[2] ..... A43D 5/00

[52] U.S. Cl. ..... 12/114.8; 211/34

[58] Field of Search ..... 223/111, 113, 114, 115, 223/116, 77, 120, 61; 211/34, 38, 37; 248/161, 356; 12/128 V, 128 C, 114.8

[56] References Cited

U.S. PATENT DOCUMENTS

| | | | |
|---|---|---|---|
| 28,927 | 6/1860 | Wheeler | 223/114 |
| 1,862,168 | 6/1932 | Weiskotten | 12/114.8 |
| 2,408,640 | 10/1946 | Hilton | 223/115 |
| 3,835,486 | 9/1974 | Benoit et al. | 248/161 X |
| 3,907,115 | 9/1975 | Satchell | 211/34 |
| 3,952,877 | 4/1976 | Kindl | 248/356 X |

FOREIGN PATENT DOCUMENTS

| | | | |
|---|---|---|---|
| 2306864 | 8/1974 | Fed. Rep. of Germany | 12/114.8 |
| 1265155 | 5/1961 | France | 211/37 |
| 198399 | 9/1938 | Switzerland | 12/114.8 |

*Primary Examiner*—George H. Krizmanich
*Attorney, Agent, or Firm*—Burton & Dorr

[57] ABSTRACT

A boot tree for straightening the upper portions of boots extending from the inner heel portion to the tug straps of said boots. The boot tree comprises two elongated hollow tubes with a coil spring disposed therein, wherein the second elongated tube is rotated with respect to the first elongated tube to lengthen or shorten the boot tree. A handle, disposed on the upper portion of the boot tree with downwardly extending hooks on either side, is pushed down and inserted into the tug straps so that when the handle is released, the tension from the coil spring lifts the upper portions of the boots to a straightened position.

4 Claims, 6 Drawing Figures

BOOT STRAIGHTENING DEVICE

BACKGROUND OF THE INVENTION

1. Field of the Invention

The present invention relates to boot trees and more particularly to expandable boot trees capable of straightening the upper portions of boots to place them in substantially their originally manufactured position.

2. Description of the Prior Art

Prior to the application for this Letters Patent, the Applicant caused to be conducted a novelty investigation of the prior art. The following patents were generated in the prior art search:

| Inventor | Patent No. | Date |
|---|---|---|
| Moland | 1,650,846 | Nov. 29, 1927 |
| Weiskotten | 1,862,168 | June 7, 1932 |
| Plotkin | 2,206,974 | July 9, 1940 |
| Plotkin | 2,253,725 | Aug. 26, 1941 |
| McCabe | 3,187,357 | June 8, 1965 |
| Thompson | 3,986,221 | Oct. 19, 1976 |

Plotkin (U.S. Pat. No. 2,253,725 issued Aug. 26, 1941) discloses the use of a spring surrounding the shaft to apply pressure to the boot. The spring is compressed to enable the tree to be inserted into the loops while the tree can be adjusted to different heights by means of holes 54. Plotkin also discloses a boot tree utilizing a threaded shaft with a unit having hooks extending therefrom, which rotates about the shaft for attachment of the hooks to the tug straps.

The patent issued to McCabe (U.S. Pat. No. 3,187,357) discloses the use of a compression spring in the handle portion which applies pressure to the strap holders. Adjustment for different heights is by holes 32.

Plotkin (U.S. Pat. No. 2,206,974) teaches the use of a threaded rod with a universal footing adaptable to any shoe tree C.

The patent issued to Thompson (U.S. Pat. No. 3,986,221) discloses wedge-shaped grooves in the center shaft portion whereby the crossbar member containing the tug strap hooks is moved upwardly to apply pressure to the tug straps.

The patent issued to Moland (U.S. Pat. No. 1,650,846) relates to a boot tree which is adapted to be mounted to a boot for supporting and stretching the boot when not in use. Referring to FIG. 1, Moland discloses a yoke member 25 mounted to the shaft 10 to adjust pressure on the hook members 27, which are inserted into the tug straps of a boot.

The patent issued to Weiskotten (U.S. Pat. No. 1,862,168) discloses a combination boot and shoe tree. Weiskotten discloses the use of a clip slideably attached to the center posts 12 for applying pressure on the tug straps via hooks 17.

None of the above prior art approaches teaches the Applicant's invention which relates to a simple and easily manufactured boot tree. Specifically, all of the above approaches are complex and difficult to manufacture.

SUMMARY OF THE INVENTION

The present invention comprises an improved apparatus for straightening the upper portions of boots. The apparatus is comprised of two hollow elongated tubes of substantially the same length, having a coil spring disposed therein which is longer than the length of each of the hollow tubes. There is an indent formed in the second hollow tube, engaging the uniform space between each coil of the coil spring, which acts as a guide to move the second hollow tube up or down the coil spring on the inside of the first tube, thus lengthening or shortening the apparatus of the present invention to adapt it to different height boots. A cushion is also disposed on the end of the second hollow tube, which rests on the inner heel portion of the boot. A handle portion consisting of two opposing substantially horizontal sections terminating on the outer ends in downwardly extending hooks is provided at the first end of the first hollow tube. By applying pressure to the handle portion, thereby depressing the coil spring disposed in the hollow tubes, the hook portions of the handle can be inserted into the tug straps of a boot. When the pressure is released from the handle portion, the hook portions, due to the tension of the coil spring, lift the upper portions of the boot to an upright position.

OBJECTS OF THE INVENTION

It is an object of the present invention to provide a new and novel device for straightening boots.

It is a further object of the present invention to provide a new and novel device for straightening boots which is simple in construction and easy to manufacture.

It is another object of the present invention to provide a new and novel device for straightening boots which is low cost to the consumer.

It is another object of the present invention to provide an apparatus for straightening the upper portions of boots having a first and a second hollow elongated tube, a coil spring operatively disposed between said tubes so that the second tube can be adjusted in vertical positioning with respect to the first tube and wherein said first tube can be manually pushed down over said second tube so that a handle disposed on the upper end of the first tube can engage the tug straps of a boot.

It is another object of the present invention to provide a new and novel device for straightening boots having first and second elongated tubes of substantially the same length but wherein the second tube has an outer diameter slightly less than the inner diameter of the first tube; a coil spring disposed between the first and second tubes having one end engaging the upper end of the first tube and a second opposing end engaging the upper end of the second tube so that the second tube can be twisted with respect to the first tube and travel upwardly and downwardly along the length of the coil spring; a handle having two opposing substantially horizontal sections whereby the sections terminate in downwardly extending hooks which are capable of engaging the tug straps of a boot; and means on the bottom end of the second tube for cushioning against the inner heel portion of the boots.

Other objects, advantages and capabilities of the present invention will become more apparent as the description proceeds taken in conjunction with the accompanying drawings.

DETAILED DESCRIPTION

Figure 1:
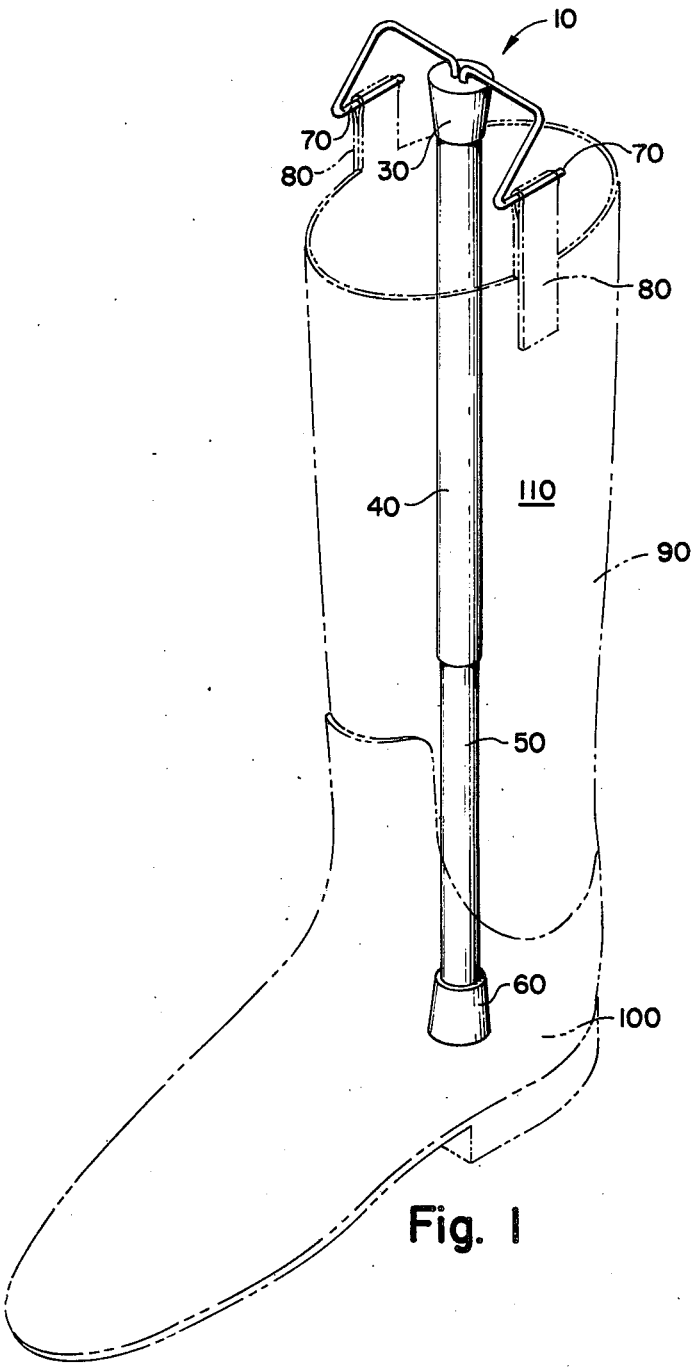
FIG. 1 is a shadow perspective view of a boot having a perspective view of the boot tree of the present invention inserted therein.

The boot tree 10 of the present invention is shown in FIG. 1 to include a handle portion 20, an upper cap 30, a first tube 40, a second tube 50, and a lower cap or cushion 60. In a manner to be described later, the downwardly extending hooks 70 are inserted into the tug straps 80 of a boot 90 to straighten the upper portion 110 of the boot 90.

It is well known that boots 90 conventionally come in varying heights and the tug straps 80 are conventionally disposed in a variety of positions on the inside and on the top of the boot 90.

Figure 2:
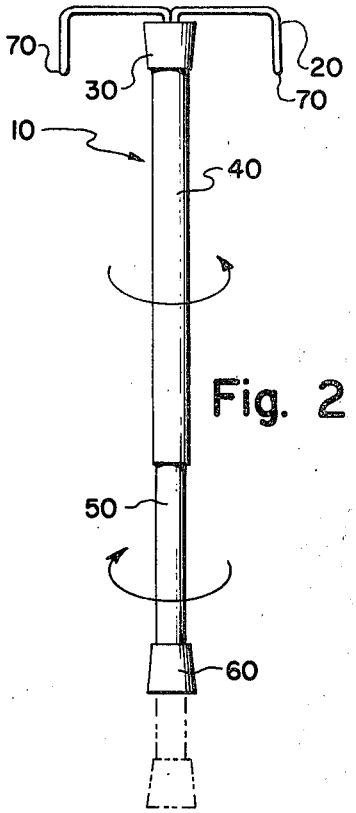
FIG. 2 is a side planar view of the boot tree of the present invention indicating the direction for lengthening.

As shown in FIG. 2 and as discussed in greater detail later, the boot tree 10 can be adjusted to conform to the height of the boot 90 by rotating the first tube 40 in a counter-clockwise direction and/or rotating the second tube in a clockwise direction, as shown by arrows in FIG. 2, thus extending the boot tree 10 to the desired length. Accordingly, to shorten the boot tree 10, the first tube may be rotated in a clockwise direction while simultaneously rotating the second tube in a counter-clockwise direction. The height is such, usually after trial and error, the downwardly extending hooks 70, when engaging the tug straps 80, forceably hold the portions 110 upright as shown in FIG. 1.

Figure 3:
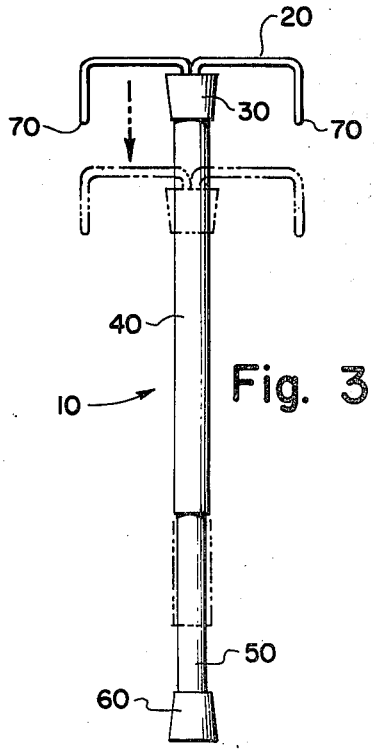
FIG. 3 is a side planar view of the boot tree of the present invention indicating the direction for insertion into a boot.

Once the boot tree 10 is extended or shortened to its desired height, it is inserted into a boot 90, by placing the lower cushion 60 on the inner heel portion 100 of the boot as shown in FIG. 1. Pressure is applied to the handle portion 20, as illustrated in FIG. 3, in an amount sufficient to lower the downwardly extending hooks 70 so they may be inserted into the tug straps 80 of the boot. The pressure is then released from the handle portion 20 thus straightening the upper portion 100 of the boot 90 to an upright position.

The operation of the boot straightening device 10 is, thus, quite simple and efficient. Once the tree 10 is set for a particularly sized boot, it can be rapidly pressed into position to engage the tug straps 80. Once the tree 10 engages the boot 90 in the position shown in FIG. 1, a conventional leather conditioner can be applied to the boot portion 90, allowed to relax the leather and, when dried, assume a "new" shape due to the pressure applied by the device 10 of the present invention.

Figure 4:
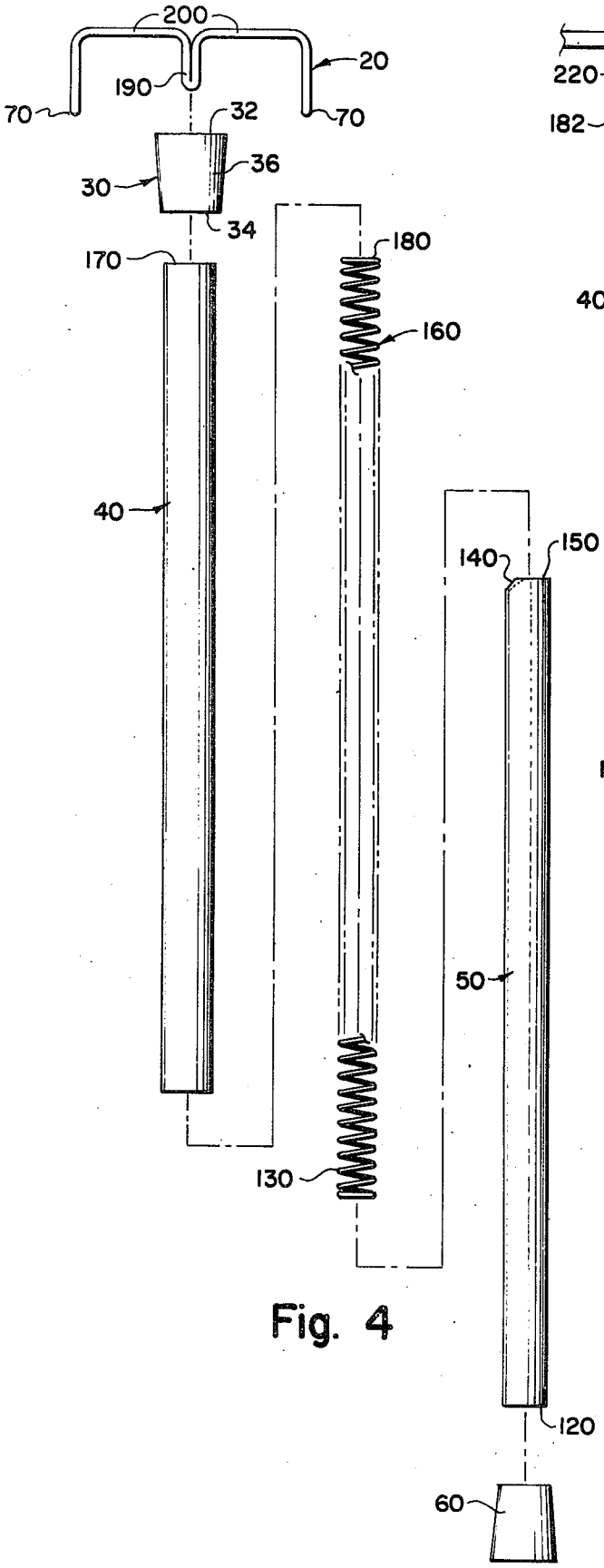
FIG. 4 is an exploded perspective view of the boot tree of the present invention illustrating the component parts of the present invention.

The cylindrical tubes 40 and 50, shown in FIG. 4, are substantially the same length with the outer diameter of tube 50 being slightly less than the inner diameter of tube 40. Tube 50 is designed so that it can freely slide up and down within tube 40. In the preferred embodiment, the first and second tubes are made of light-weight aluminum; however, it is to be understood that any durable rigid material would suffice.

As shown in FIG. 4, the second end 120 of the second tube 50 is inserted into the lower cushion 60. In the preferred embodiment, the upper cap 30 and the lower cushion 60 are conventional rubber grommets, however, it is to be understood that these cushions and grommets may be made of any material suitable for protecting surfaces of the boot and the sharp edges of the tubes 40 and 50. Each cap 30 and 60 has a substantially flat parallel horizontal surface 32 and 34 with tapering conical sides 36. The interior of each cap is cylindrically shaped to press-fit against the outer surfaces of tubes 40 and 50. The upper cap 30 has a hole or opening 220 formed therethrough.

Figure 6:
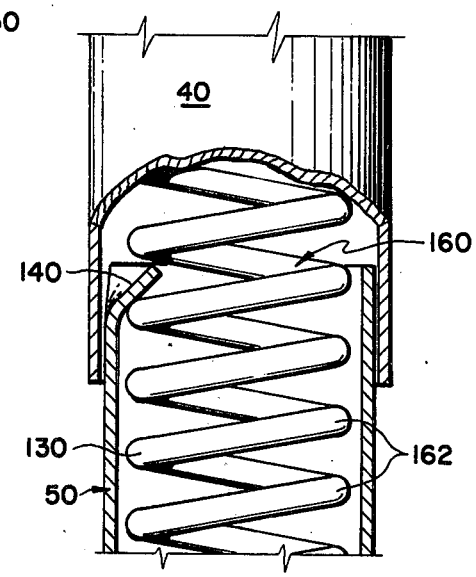
FIG. 6 is a partial cut-away view of the boot tree of the present invention showing the indented portion engaging the coil spring and the outer tube portion.

The coil spring 130, consisting of a plurality of spiral coils, whose outer diameter is slightly less than the inner diameter of the second tube 50, is inserted into the first tube 40 and affixed to the upper end 170 in a manner to be subsequently explained. It is to be noted that the length of the coil spring 130 is greater than the length of the first tube 40. An inwardly directed indent 140, as best shown in FIG. 6, is formed in the first end 150 of the second tube 50. This inwardly directed indent is positioned in the uniform space 160 between each coil 162 of the coil spring 130 to act as a guide or thread when rotating the first and second tubes 40 and 50 to lengthen or shorten the boot tree as priorly discussed. The indent 140 is formed in the first end 150 of tube 50 by striking the end of the tube with a sharp edge thereby causing the end 150 to deform into the indent 140.

The handle portion 20 consists of a U-shaped center nipple 190, shown in FIG. 4, having opposing substantially horizontal sections 200, and downwardly extending hooks 70. The U-shaped center nipple portion 190 extends into substantially horizontal sections 200 which thereupon extend into rearwardly downwardly hook portions 70, which angle forwardly at approximately 40° angles. It is to be understood that this slight angle prevents the tug straps 80 from slipping off the downwardly extending hooks 70. The handle 20 is of integral construction being made from heavy gauge wire.

Figure 5:
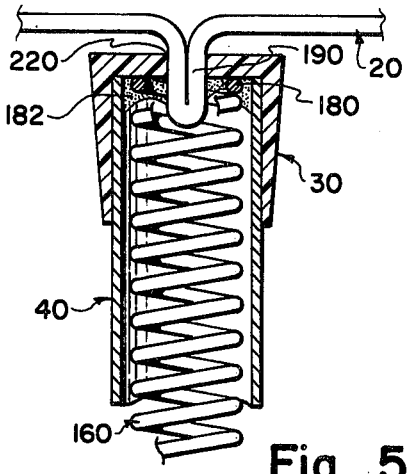
FIG. 5 is a cut-away view of the upper portion of the boot tree of the present invention illustrating the mounting of the handle.

The U-shaped center nipple 190, as shown in FIG. 5, is positioned in the upper cap 30 through opening 220. The upper cap 30 is positioned over the first end 170 of the first tube 40. As can be seen in FIG. 5, the first end 180 of the coil spring 130, as well as the U-shaped center nipple 190 of the handle portion, are epoxied 182 to the inner portion of the upper cap 30 to retain the coil spring and the U-shaped center nipple portion 190 in a stationary position. The end 180 of the coil spring 130 is centrally disposed within said first tube 40.

Although the present invention has been described with a certain degree of particularity, it is understood that the present disclosure has been made by way of example and that changes in details of structure may be made without departing from the spirit thereof.

I claim:

1. An apparatus for straightening the upper portions of boots, said boots having an inner heel portion on the inside of said boots, said apparatus comprising:

first and second hollow elongated tubes, said first and second tubes being substantially the same length, said second tube having an outer diameter slightly less than the inner diameter of the first tube, a coil spring having a plurality of spiral coils, each of said coils being separated by a uniform space; said coil spring having an outer diameter slightly less than the inner diameter of said second tube and having a length greater than the length of said second tube, but less than the combined length of said first and second tubes, a handle having two opposing substantially horizontal sections, each of said sections having means for engaging opposing top ends of said upper portions, means for connecting the center of said handle to a first end of said first tube, said connecting means further connecting a first end of said spring to said first end of said first tube, said spring being centrally oriented in the hollow area of said first tube, means on a first end of said second tube for engaging said space between said coils of said spring, said second tube being disposed between said coil spring and said second tube and being capable of traveling up and down said coil spring by manually turning each of said tubes in opposing direction about their common longitudinal axis, and means on the second end of said second tube for cushioning against said inner heel portion of said boots when said handle is pushed downwardly against the bias of said coil spring in the direction of said cushioning means said engaging means selectively engages said top end of said upper portions and when said handle is released said coil spring forcibly straightens the upper portions of said boots.

2. An apparatus for straightening the upper portions of boots, said boots having an inner heel portion on the inside of said boots, said apparatus comprising:

first and second hollow elongated tubes, said first and second tubes being substantially the same length, said second tube having an outer diameter slightly less than the inner diameter of the first tube, a coil spring having a plurality of spiral coils, each of said coils being separated by a uniform space; said coil spring having an outer diameter slightly less than the inner diameter of said second tube and having a length greater than the length of said second tube, but less than the combined length of said first and second tubes, a handle having two opposing substantially horizontal sections, each of said sections having means for engaging opposing top ends of said upper portions, means for connecting the center of said handle to a first end of said first tube, said connecting means further connecting a first end of said spring to said first end of said first tube, said spring being centrally oriented in the hollow area of said first tube, means on a first end of said second tube for engaging said space between said coils of said spring, said second tube being disposed between said coil spring and said second tube and being capable of traveling up and down said coil spring by manually turning each of said tubes in opposing direction about their common longitudinal axis, said engaging means comprising an inwardly directed indent formed on the upper edge of said first end of said second tube, and means on the second end of said second tube for cushioning against said inner heel portion of said boots when said handle is pushed downwardly against the bias of said coil spring in the direction of said cushioning means said engaging means selectively engages said top end of said upper portions and when said handle is released said coil spring forcibly straightens the upper portions of said boots.

3. An apparatus for straightening the upper portions of boots, said boots having an inner heel portion on the inside of said boots, said apparatus comprising:

first and second hollow elongated tubes, said first and second tubes being substantially the same length, said second tube having an outer diameter slightly less than the inner diameter of said first tube, a coil spring having a plurality of spiral coils, each of said coils being separated by a uniform space; said coil spring having an outer diameter slightly less than the inner diameter of said second tube and having a length greater than the length of said second tube, but less than the combined length of said first and second tubes, a handle formed from a rod having two opposing substantially horizontal sections, each of said sections having means for engaging opposing top ends of said upper portions and having a downwardly extending U-shaped center nipple between said horizontal sections, means for connecting said center nipple of said handle to a first end of said tube, said connecting means further connecting a first end of said spring to said first end of said tube, said spring being centrally oriented in the hollow area of said first tube, means on a first end of said second tube for engaging said space between said coils of said spring, said second tube being disposed between said coil spring and said second tube and being capable of traveling up and down said coil spring by manually turning each of said tubes in opposing direction about their common longitudinal axis, and means on the second end of said second tube for cushioning against said inner heel portion of said boots when said handle is pushed downwardly against the bias of said coil spring in the direction of said cushioning means said engaging means selectively engages said top end of said upper portions and when said handle is released said coil spring forcibly straightens the upper portions of said boots.

4. An apparatus for straightening the upper portions of boots, said boots having an inner heel portion on the inside of said boots, said apparatus comprising:

first and second hollow elongated tubes, said first and second tubes being substantially the same length said second tube having an outer diameter slightly less than the inner diameter of said first tube, a coil spring having a plurality of spiral coils, each of said coils being separated by a uniform space; said coil spring having an outer diameter slightly less than the inner diameter of said second tube and having a length greater than the length of said second tube, but less than the combined length of said first and second tubes, a handle formed from a rod having two opposing substantially horizontal sections, each of said sections having means for engaging opposing top ends of said upper portions and having a downwardly extending U-shaped center nipple between said horizontal sections, means for connecting said center nipple of said handle to a first end of said tube, said connecting means further connecting a first end of said spring to said first end of said tube, said spring being centrally oriented in the hollow area of said first tube, means on a first end of said second tube for engaging said space between said coils of said spring, said second tube being disposed between said coil spring and said second tube and being capable of traveling up and down said coil spring by manually turning each of said tubes in opposing direction about their common longitudinal axis, said engaging means comprising an inwardly directed indent formed on the upper edge of said first end of said second tube, and means on the second end of said second tube for cushioning against said inner heel portion of said boots when said handle is pushed downwardly against the bias of said coil spring in the direction of said cushioning means said engaging means selectively engages said top end of said upper portions and when said handle is released said coil spring forcibly straightens the upper portions of said boots.

* * * * *